US005657976A

United States Patent [19]

Cohen et al.

[11] Patent Number: 5,657,976

[45] Date of Patent: Aug. 19, 1997

[54] ACCUMULATOR FOR PAPER OF DIFFERENT LENGTHS

[75] Inventors: Steven E. Cohen, Seymour, Conn.; Eric D. Kolb, Mansfield, Ohio; James A. Salomon, Cheshire, Conn.

[73] Assignee: Pitney Bowes, Inc., Stamford, Conn.

[21] Appl. No.: 594,061

[22] Filed: Jan. 29, 1996

[51] Int. Cl.[6] ..... B41F 13/54; B65H 39/00

[52] U.S. Cl. ..... 270/1.02; 270/52.09

[58] Field of Search ..... 270/10, 18, 1.02, 270/52.07, 52.09

[56] References Cited

U.S. PATENT DOCUMENTS

| | | | |
|---|---|---|---|
| 2,214,593 | 9/1940 | Mustin et al. | 270/52.09 X |
| 3,983,679 | 10/1976 | Zemke | 270/52.09 X |
| 4,034,973 | 7/1977 | Hams | 270/52.09 X |
| 4,800,505 | 1/1989 | Axelrod et al. | 270/1.02 X |
| 5,104,105 | 4/1992 | Cote et al. | 270/1.02 |
| 5,348,277 | 9/1994 | Crowley | 270/52.07 X |

*Primary Examiner*—Hoang Nguyen

*Attorney, Agent, or Firm*—Ronald Reichman; Lawrence E. Sklar; Melvin Scolnick

[57] ABSTRACT

Apparatus for accumulating sheets of material. The apparatus includes: a housing; a continuous web of sheet material supported by the housing; a device to advance the continuous web; a device to sever the continuous web into strips of a desired length; and a device for accumulating a strip or a plurality of strips into a single collation, wherein the plurality includes one or more strips of a given length and only one strip of a variable length equal to or less than the given length.

8 Claims, 6 Drawing Sheets

ACCUMULATOR FOR PAPER OF DIFFERENT LENGTHS

BACKGROUND OF THE INVENTION

The instant invention relates to apparatus for accumulating strips of labels of different lengths, and more particularly to such apparatus for use in a presenter of a kiosk for postage labels.

Apparatus for accumulating sheets or strips of paper or similar, flexible material is well known. The sheets or strips are fed seriatim from an upstream location and are accumulated against a registration point to form a stack which can then be removed by an operator or conveyed downstream for further processing. The prior art accumulators are designed to function with sheets or strips of uniform length. Clearly, there are many applications where it would be desirable to be able to accumulate sheets or strips of different length.

One application where accumulating strips of different lengths would be desirable is that of printing postage labels with pressure sensitive adhesive on releasable strips of paper. Such postage label strips would be dispensed by a kiosk to a user having access thereto. If two different lengths of strips can be dispensed by the presenter of the kiosk, then it is possible to dispense any varied number of postage labels desired by the user as long as one of the lengths of strips can be varied as determined by the user.

Accordingly, the instant invention provides apparatus for accumulating sheets or strips of paper in which the accumulation consists of one or more sheets of a pre-determined length and a final sheet or strip of a variable length equal to or less than the pre-determined length. Such apparatus could be used to dispense any required amount of labels from, for example, a kiosk.

SUMMARY OF THE INVENTION

Thus the instant invention provides apparatus for accumulating sheets of material. The apparatus includes: a housing; a continuous web of sheet material supported by the housing; means to advance the continuous web; means to sever the continuous web into strips of a desired length; and means for accumulating a single strip or a plurality of strips into a single collation, wherein the plurality includes one or more strips of a given length and only one strip of a variable length equal to or less than the given length.

DETAILED DESCRIPTION OF THE PREFERRED EMBODIMENT

Figure 1:
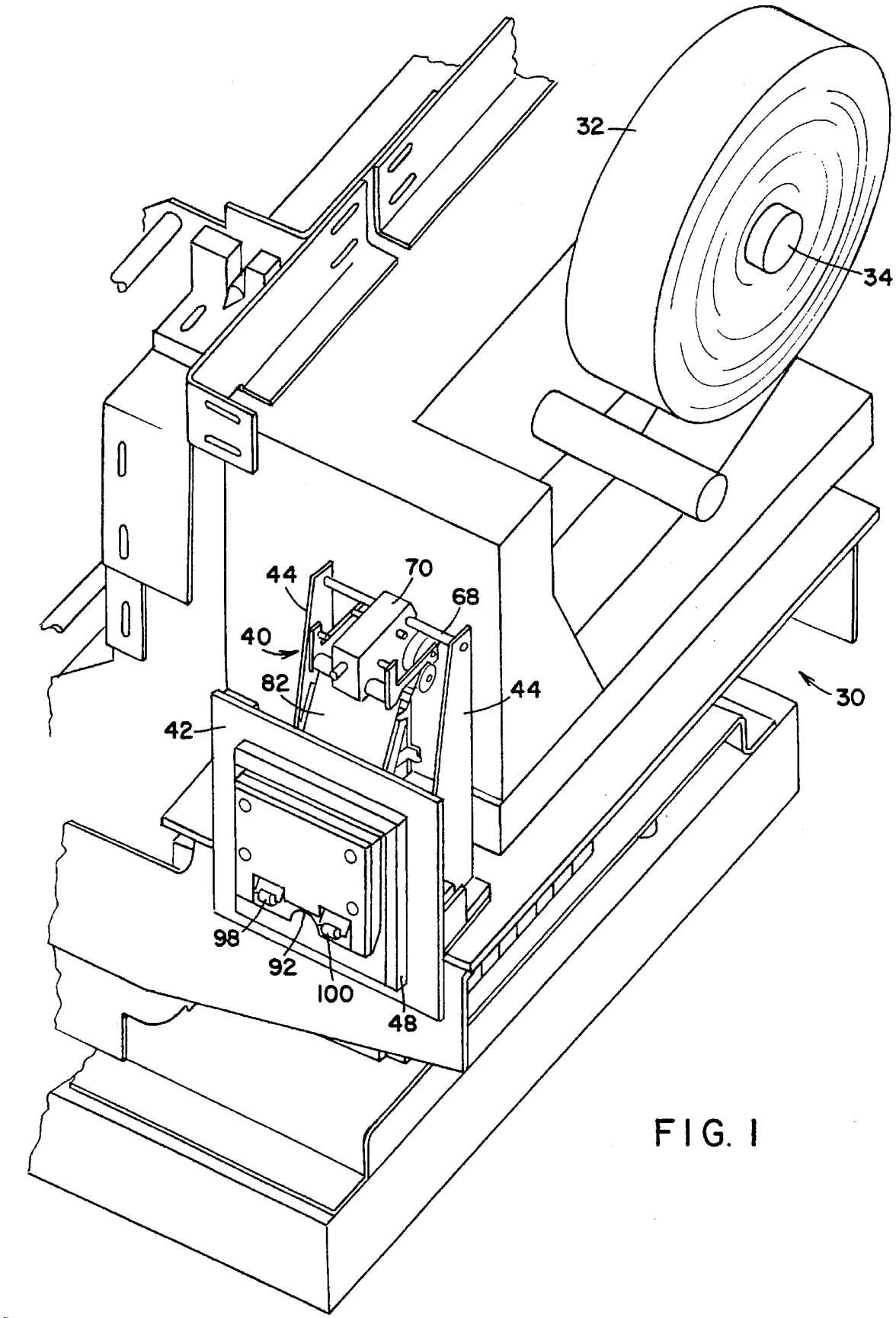
FIG. 1 is a perspective view of a postage label kiosk incorporating a label accumulator in accordance with the instant invention.
Figure 2:
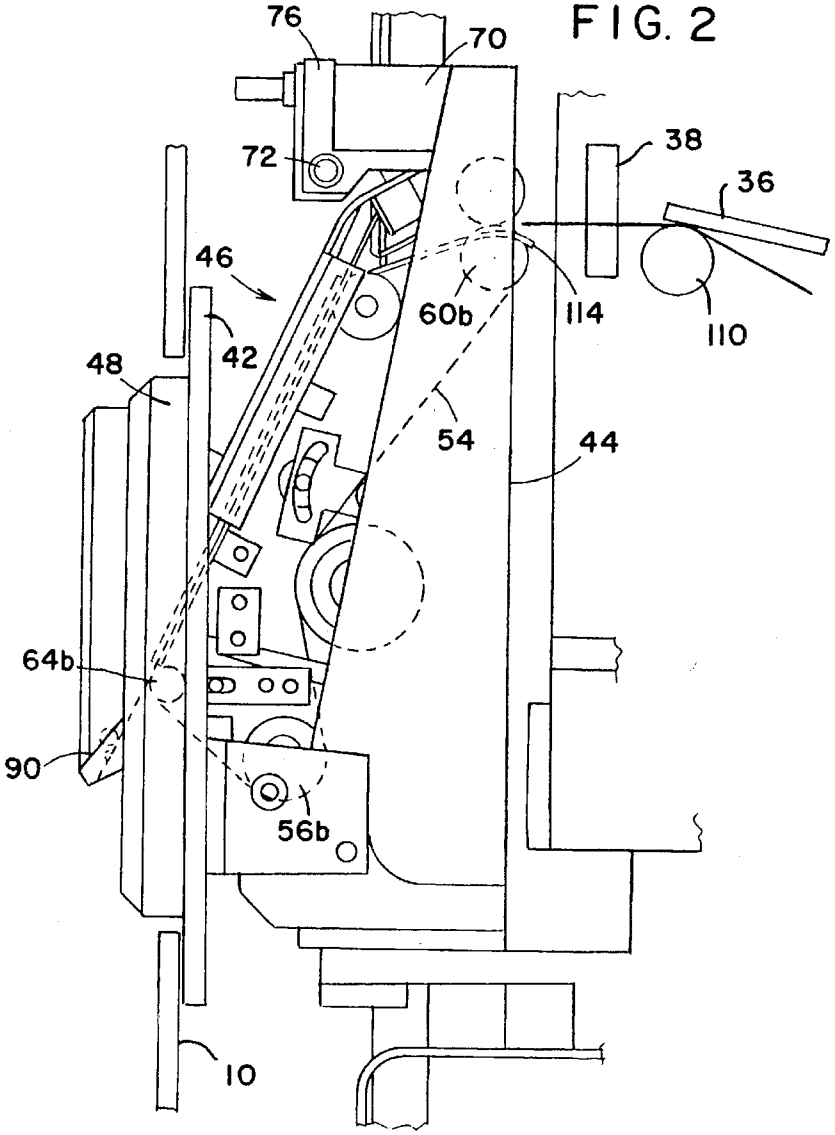
FIG. 2 is a side, elevational view of the presenter for the kiosk shown in FIG. 1.
Figure 6:
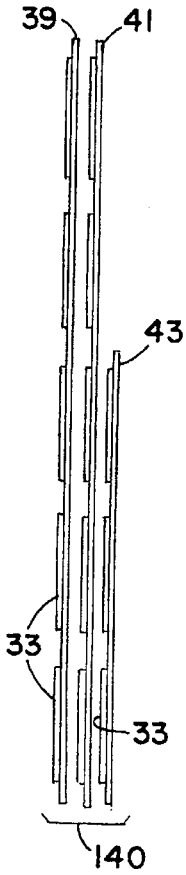
FIG. 6 is a schematic, side, elevational view of two strips of paper carrying five labels and a third strip of paper supporting three labels for a total of 13 labels.
Figure 7:
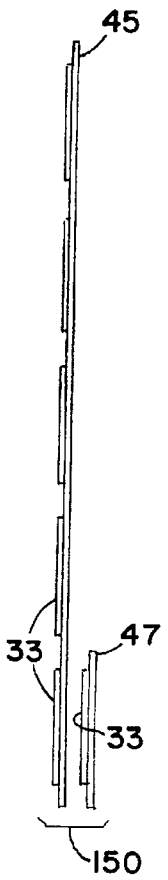
FIG. 7 is similar to FIG. 6 but shows a single strip of paper carrying five labels and a second strip of paper supporting one label for a total of six labels.

In describing the preferred embodiment of the instant invention, reference is made to the drawings, wherein there is seen in FIG. 1 a postage dispensing kiosk generally designated 10 which houses a metering subsystem 30 which supports a roll or web of paper stock 32 having releasable labels 33 on one surface thereof (see FIGS. 6 and 7). The roll 32 is mounted on a shaft 34 of the subsystem 30, which additionally includes a printing mechanism 36 (see FIG. 2.) for printing postage on the various labels 33, and a cutting device 38 for severing the paper stock roll 32 into strips 39, 41 and 43 (see FIG. 6) or strips 45 and 47 (see FIG. 7), as will be explained in further detail hereinbelow. The subsystem 30 also includes a presenter 40 for enabling a user, i.e. a customer, of the kiosk 10 to remove the printed postage label strips from the kiosk 10.

The presenter 40 includes a front cover 42 which is pivotably secured to the presenter housing frames 44. The presenter 40 additionally includes an accumulator generally designated 46 (see FIGS. 4, 5, 8 and 9) and a user receiver 48 secured to the front cover 42. The accumulator 46 includes an angled deck 50 (see FIG. 4) and a pair of continuously rotating timing belts 52 and 54. The timing belt 52 is mounted on pulleys 56*a*, 58*a*, 60*a*, 62*a*, and 64*a* and the timing belt 54 is mounted on respectively mating pulleys 56*b*, 58*b*, 60*b*, 62*b* and 64*b* (see FIG. 5). The pulleys 56*a*, and 56b*b* are mounted on a driven shaft 66 which is continuously driven by a conventional belt, drive shaft and motor which are not shown.

Mounted to the side frames 44 is a shaft 68 which rotatably supports a block member 70 (see FIG. 8) which, in turn, supports a shaft 72. At the ends of the shaft 72 are a pair of spring loaded, L-shaped arms 74 and 76. The lower ends of each of the arms 74 and 76 support a pair of rollers 78 and 80 respectively which cooperate with the belts 52 and 54 respectively above the pulleys 60*a* and 60*b* respectively. Extending from the block member 70 is a bracket 82 which supports a pair of skis 84 and 86 from its end nearest to the block member 70. The skis 84 and 86 are located above the belts 52 and 54 respectively.

Figure 3:
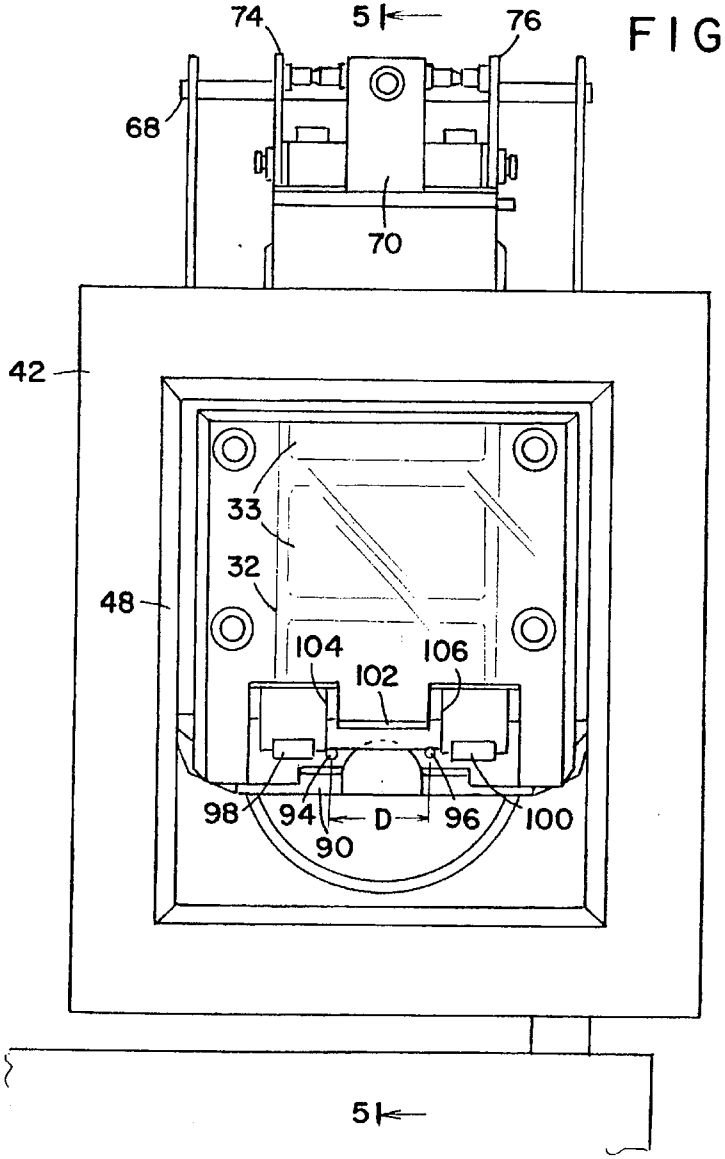
FIG. 3 is a front, elevational view of the presenter seen in FIG. 2.
Figure 4:
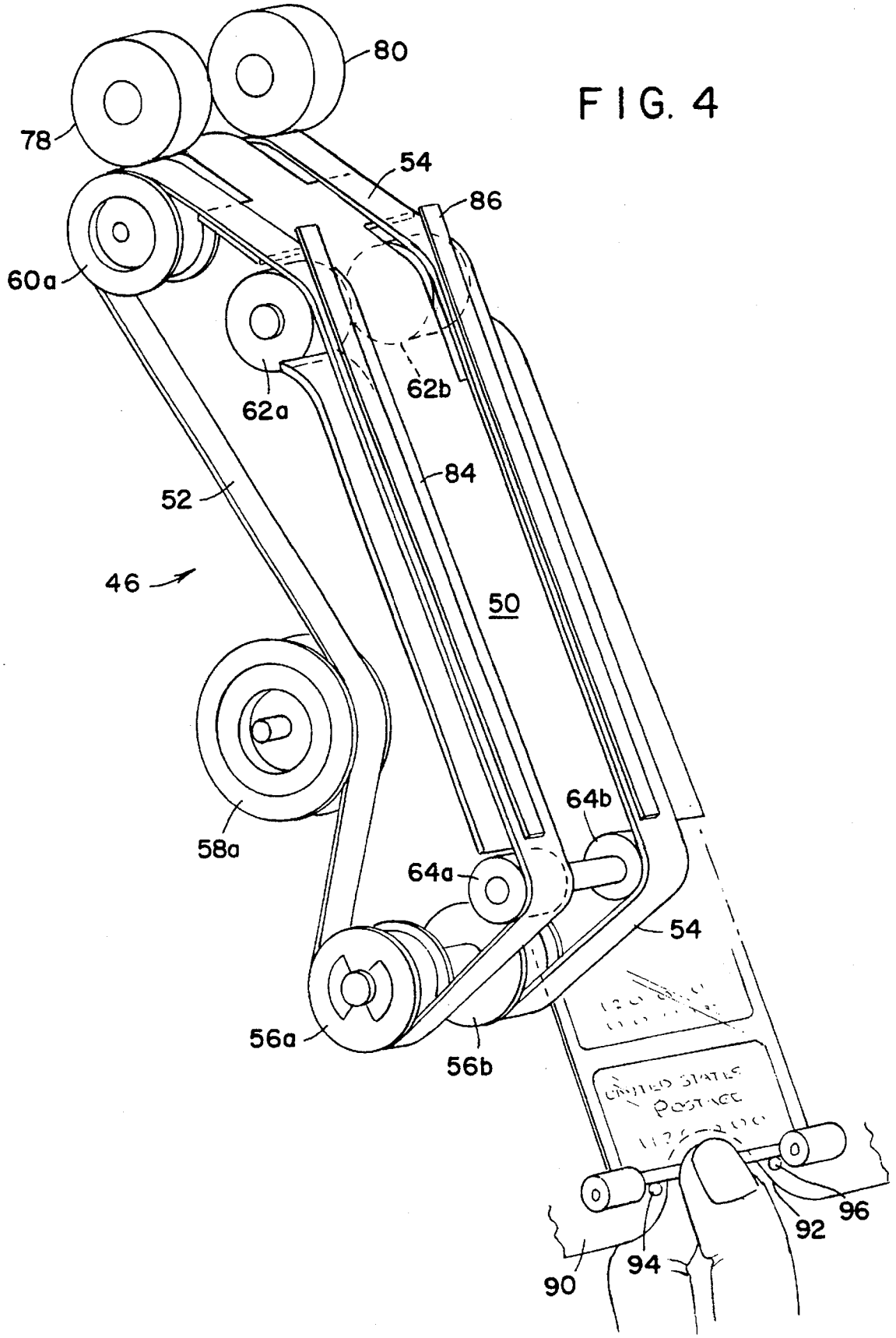
FIG. 4 is a perspective view of the accumulator used in the presenter seen in FIGS. 2 and 3.
Figure 5:
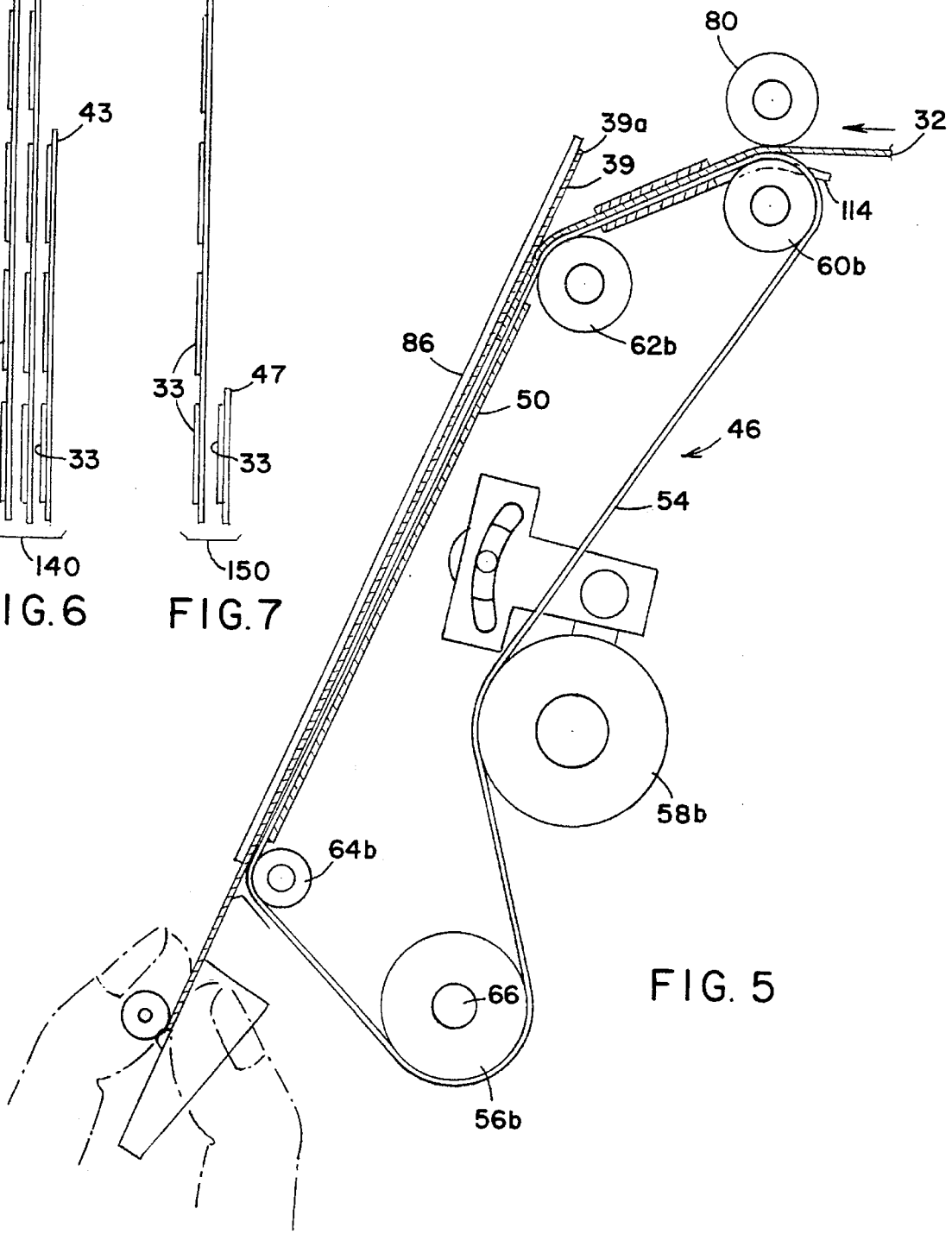
FIG. 5 is a sectional view taken on the plane indicated by the line 5—5 in FIG. 3.

The receiver 48 includes a cut-out plate 90 having a semi-circular opening 92 to accommodate the thumb and forefinger of a user, as seen in FIGS. 4 and 5. The plate 90 has a pair of protuberances 94 and 96 (see FIGS. 3 and 4) on either side of the opening 92. A pair of exit rollers 98 and 100 are located adjacent and outside the pair of protuberances 94 and 96 respectively. The receiver 48 includes an opening 102 (see FIG. 3). A pair of arms 104 and 106 extend from the receiver 48 above the opening 102 and support the exit rollers 98 and 100 respectively. The arms 104 and 106 essentially lie above the cut-out plate 90.

Referring now to FIG. 6, there are shown three strips 39, 41 and 43 which have been cut from the roll stock 32 by the cutting device 38. Each of the strips 39 and 41 is of a length to include five (5) releasable labels 33. The third strip 43 is of a lesser length such that it includes only three (3) labels 33. Accordingly, the two strips 39 and 41 are of a given length and provide ten labels 33, while the third strip 43 is of a length less than the given length of the strips 39 and 41 and provides three labels 33. Thus, the total number of labels provided by the three strips 39, 41 and 43 is thirteen (13).

Referring now to FIG. 7, there are shown two strips 45 and 47 which have been cut from the roll stock 32 by the cutting device 38. The strip 45 is of a length to include five (5) releasable labels 33 and the second strip 47 is of a lesser length such that it includes only one (1) label 33. Accordingly, the two strips 45 and 47 provide a total of six labels 33.

From the foregoing description of FIGS. 6 and 7, it can be seen that by using any number of strips of a given length (e.g. five labels) and a single strip of a variable length less than the given length (e.g. one to four labels), that any combination of labels 33 can be produced up to the capability of the metering subsystem 30 and the presenter 40. For example, if three labels 33 are desired, a single strip of three labels 33 is cut and dispensed. If twenty four labels 33 were desired, four strips of five labels 33 and a single strip of four labels 33 would be cut and dispensed.

The manner of dispensing the labels 33 will now be discussed. The kiosk 10 includes a central processing unit, a data storage unit and input capabilities (not shown) which permit a user (customer) to direct the metering subsystem 30 to dispense a particular number of printed postage labels of a particular denomination. The postage indicias are printed on the labels 33 by the printer 36. The labels 33 are releasably secured to the paper stock 32 which is advanced by the printer 36 by means of a platen roller 110 which feeds the stock 32 over a guide 114 to the pulley 60*a* and the roller 78 and the pulley 60*b* and the roller 80 respectively (see FIGS. 4 and 5) and thence over the pulleys 62*a* and 62*b* and under the skis 84 and 86. At an appropriate time determined by the central processing unit, the cutter 38 is activated to sever the web stock 32 into a length such that it includes one, two, three, four or five labels 33, and, if more than five labels 33 are required, the roller 110 continues to feed the web stock 32 and the cutter 38 is again activated at an appropriate time to sever the web stock 32 into whatever length is required to provide the required number of labels 33 up to five. The process of severing the web stock 32 continues until all of the labels 33 required by the central processor are provided. Each severed strip, such as strip 39, bends around the pulleys 62*a* and 62*b* and passes under the skis 84 and 86 until driven down to rest against the protuberances 94 and 96 on the receiver plate 90.

As best seen in FIG. 5, the length of a full strip, such as strip 39, is greater than the distance D between the protuberances 94 and 96 against which the strip 39 comes to rest and the pulleys 62*a* and 62*b*. This relationship insures that each succeeding strip emerging from the cutter 38, such as strips 41 and 43, will pass below the upstream end 39*a* of the strip 39 as it is being carried by the continuously running belts 52 and 54. Any number of succeeding strips consistent with the capability of the apparatus can be accumulated against the protuberances 94 and 96 as long as they are of the same length and longer than the distance D. The final strip to be accumulated, such as strip 43, can be any length which is equal to or less than the distance D, since it does not need to have an upstream end under which a succeeding strip can pass. By virtue of the belts 52 and 54 having to bend around the pulleys 62*a* and 62*b*, the accumulating strips on the deck 50 create a gap with the belts 52 and 54 between the pulley pairs 60 (*a* and *b*) and 62 (*a* and *b*) for each succeeding strip to enter. Thus, since each different length of strip corresponds to a given number of labels, it can be seen that an accumulation can be generated against the protuberances 94 and 96 consisting of virtually any number of labels with the only limitation being that all of the strips except the last strip be of a uniform length, and that the last strip be of a length equal to or less than the uniform length. Thus, an accumulation of 15 labels would consist of three strips of 5 labels each; an accumulation of 13 labels would consist of two strips of 5 labels each and a final strip of three labels. Obviously, a strip could be of such a length that it could include more than or less than five labels, and the accumulations would be generated with different length strips, but the same approach would apply; i.e. all but the final strip are of the same length greater than the distance D, and the final strip is equal to or less than the length of the other strips.

Once the accumulation of strips, such as the accumulation 140 in FIG. 6, or accumulation 150 in FIG. 7, comes to rest against the protuberances 94 and 96 in the receiver 48, a user places a thumb and forefinger, as seen in FIGS. 4 and 5, around the bottom of the accumulation 140 and 150, and pulls downward to remove the accumulation 140 and 150, which passes out of the receiver 48 under the exit rollers 98 and 100.

Figure 8:
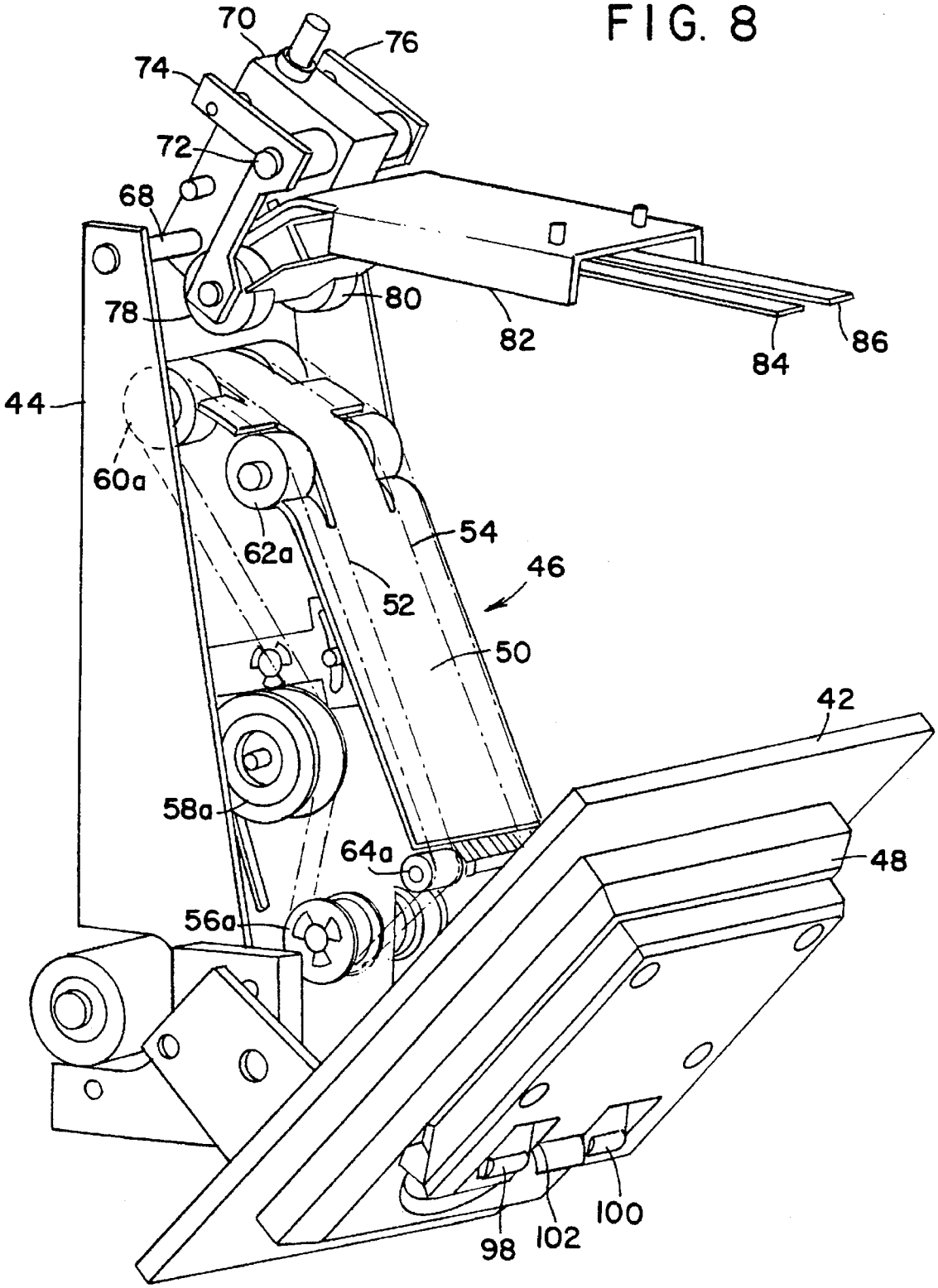
FIG. 8 is a perspective view of the presenter with the front cover and certain ski apparatus pivoted away from the conveying belts to facilitate jam clearance; and, FIG. 9 is a side, elevational view of the presenter as seen in FIG. 8.
Figure 9:
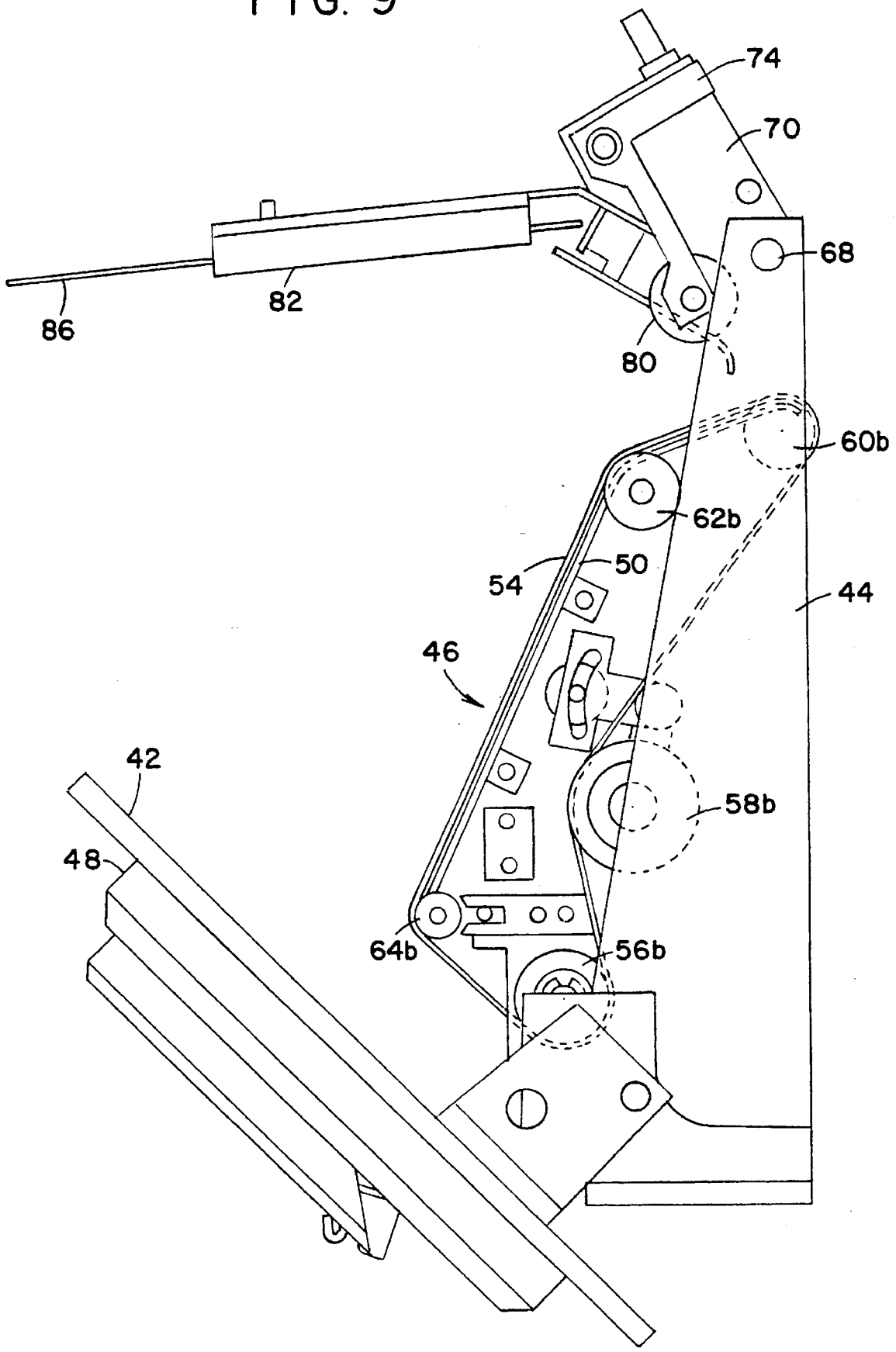

FIG. 8 shows that in the event that a jam develops within the presenter 40, that the paper path along the belts 52 and 54 can be accessed by pivoting upward the block member 70 and by pivoting downward the front cover 42.

The preferred embodiment described hereinabove relates to strips of labels 33. However, it is clear form the foregoing description that the principles of the instant invention are applicable to strips of paper regardless of whether or not they bear labels. The invention relates to accumulating, and the accumulating device, although shown in a postage dispensing kiosk, can be used in a variety of applications, with or without a presenter. The use of labels on the strips simply implies that this invention can be used to dispense any number of a flat commodity that can be secured to a strip of paper.

It should also be noted that although the deck 50 is shown angled downward from its upstream to downstream end, that it could be angled so that its downstream end is above its upstream end. Moreover, the deck 50 could be flat, or virtually any angle desired.

It should be understood by those skilled in the art that various modifications may be made in the present invention without departing from the spirit and scope thereof, as described in the specification and defined in the appended claims.

What is claimed is:

1. Apparatus for accumulating sheets of material comprising:

a housing;

a continuous web of sheet material supported by said housing;

means to advance said continuous web;

means to sever said continuous web into strips of a desired length; and means for accumulating a single strip or a plurality of strips into a single accumulation, wherein said accumulating means comprises a deck having an upstream and a downstream end, a continuously running belt trained over said deck, a ski resting on said belt, said ski having an upstream end extending beyond the upstream end of said deck, and stopping means located adjacent the downstream end of said deck, wherein said given length is longer than the length of said deck and said plurality includes one or more strips of a given length and only one strip of a variable length equal to or less than said given length.

2. The apparatus of claim 1, wherein said strip of said given length has an upstream end extending beyond said deck when said strip of said given length is stopped by said stopping means, whereby each succeeding strip accumulates on said deck between said preceding strip and said belt.

3. The apparatus of claim 2, wherein said one strip is shorter than said given length and is the final strip to accumulate on said deck.

4. The apparatus of claim 3, wherein said housing comprises a kiosk.

5. The apparatus of claim 4, wherein said web of sheet material includes labels releasably secured thereto.

6. The apparatus of claim 5, additionally comprising means for printing indicias on said labels.

7. The apparatus of claim 6, wherein said printing means are located upstream of said severing means.

8. The apparatus of claim 7, wherein said indicias comprise postage indicias.

* * * * *